US007934348B2

(12) United States Patent
Ollman

(10) Patent No.: US 7,934,348 B2
(45) **Date of Patent: *May 3, 2011**

(54) STRUCTURAL TRUSS WITH CRIMP/CLAMP

(76) Inventor: Melvin L. Ollman, Marco Island, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/824,573

(22) Filed: Jun. 28, 2010

(65) Prior Publication Data

US 2010/0257810 A1 Oct. 14, 2010

Related U.S. Application Data

(63) Continuation-in-part of application No. 11/268,785, filed on Nov. 8, 2005, now Pat. No. 7,743,577, which is a continuation-in-part of application No. 10/919,601, filed on Aug. 17, 2004, now Pat. No. 7,228,670.

(60) Provisional application No. 60/496,067, filed on Aug. 18, 2003.

(51) Int. Cl.
*E04H 12/00* (2006.01)

(52) U.S. Cl. ..... 52/650.1; 52/633

(58) Field of Classification Search ..... 52/650.1, 52/633, 637, 691
See application file for complete search history.

(56) References Cited

U.S. PATENT DOCUMENTS

| | | | | |
|---|---|---|---|---|
| 1,865,059 | A * | 6/1932 | Ragsdale | 52/691 |
| D230,265 | S | 2/1974 | Ollman | |
| 3,827,117 | A | 8/1974 | Ollman | |
| 3,882,653 | A | 5/1975 | Ollman | |
| 3,961,738 | A | 6/1976 | Ollman | |
| 4,030,256 | A | 6/1977 | Ollman | |
| 7,743,577 | B2 * | 6/2010 | Ollman et al. | 52/650.1 |

* cited by examiner

*Primary Examiner* — Basil Katcheves
(74) *Attorney, Agent, or Firm* — The Livingston Firm; Edward M. Livingston, Esq.; Bryan L. Loeffler, Esq.

(57) ABSTRACT

A structural truss (3) with crimp/clamp (18) wherein the truss (3) includes disposed U-shaped channel chords (2) and struts (1) interconnected to one another at alternately extending apices (6) wherein successive segments of the struts (1) have U-shapes and inverted U-shapes at their mid-sections and apices (6) at their respective ends. The truss member (3) also has vertical load-bearing strut sections (17) at the end of each manufactured length of truss (3) to support a cantilevered section of chord (10). The crimp/clamp (18) creates dimples (19), thereby securing the chords (2) to the struts (1).

11 Claims, 3 Drawing Sheets

STRUCTURAL TRUSS WITH CRIMP/CLAMP

CROSS REFERENCE TO RELATED APPLICATION

This application is a continuation in part of application Ser. No. 11/268,785 filed on Nov. 8, 2005, now U.S. Pat. No. 7,743,577 which is a continuation in part of application Ser. No. 10/919,601, filed on Aug. 17, 2004 now U.S. Pat. No. 7,228,670 which claims the benefit of U.S. Provisional Application No. 60/496,067, filed on Aug. 18, 2003. The patent applications identified above are incorporated in their entirety to provide continuity of disclosure.

BACKGROUND OF THE INVENTION

This invention relates to trusses, more specifically, an improved open web structural truss and process of making same.

Conventional structural trusses and methods of making same are difficult in some respects. First, the truss members of predetermined length, as described in U.S. Pat. No. 3,827,117, comprise oppositely disposed U-shaped channels between which a strut member is positioned, comprising alternately extending strut segments having flat end portions which are generally U-shaped in a cross section at the center and gradually tapering toward the flat end portions at the end. The strut member is then bent at the flat portions to form alternately extending apices which contact the opposing chord elements. When this is done, however, the opposite apices become substantially different in shape, thereby materially affecting the quality of their connections to the opposing chords. Thus, there exists a need for improvement in the quality of those connections.

Second, current production machines for the manufacturing of trusses, as described in U.S. Pat. Nos. 3,827,117 and 3,961,738, teach using preset lengths and quantities of trusses being formed continuously on the production machinery as controlled by a computer program. Although these machines efficiently manufacture the truss members described in the cited prior art at low cost with a minimum of labor and in a manner to provide uniformity and utility, these machines do not provide the following capabilities: a) providing a means for precise location for fastening struts and chords, b) providing a means for precisely measuring the distance points from apex to apex, and c) providing a vertical member for the support of the cantilevered ends of each truss length.

Finally, the quality of current trusses may be compromised at connecting points of strut and chords because of lack of uniformity of the shape of strut apices.

The prior art includes the following United States patents:

| Patent. No. | Inventor | Assignee | Filing Date | Issue Date |
|---|---|---|---|---|
| D230,265 | Ollman | C-O, Inc. | Aug. 11, 1971 | Feb. 05, 1974 |
| 3,882,653 | Ollman | C-O, Inc. | Mar. 16, 1973 | May 13, 1975 |
| 3,827,117 | Ollman | C-O, Inc. | Apr. 11, 1973 | Aug. 06, 1974 |
| 3,961,738 | Ollman | C-O, Inc. | Jul. 01, 1974 | Jun. 08, 1976 |
| 4,030,256 | Ollman | N/A | Nov. 20, 1975 | Jun. 21, 1977 |

SUMMARY OF THE INVENTION

The primary object of the present invention is to provide an improved structural truss that will provide for improved connections of strut apices to the opposing chords.

An even further object of the present invention is to provide an improved structural truss with crimp/clamp method that provides both horizontal and lateral strength to the strut/chord connection.

The present invention fulfills the above and other objects by providing two improved strut segments where one strut segment is inverted U-shaped and the other is U-shaped. By having segments with both a U-shape and inverted U-shape, those portions of the strut contacting the opposing chords may have identically-shaped flat sections, rounded sections, bent sections, etc. to facilitate the joining of the strut and the chords.

The above and other objects, features, and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of a preferred embodiment with reference to the following drawings which are explained briefly as follows:

DESCRIPTION OF PREFERRED EMBODIMENT

Figure 1:
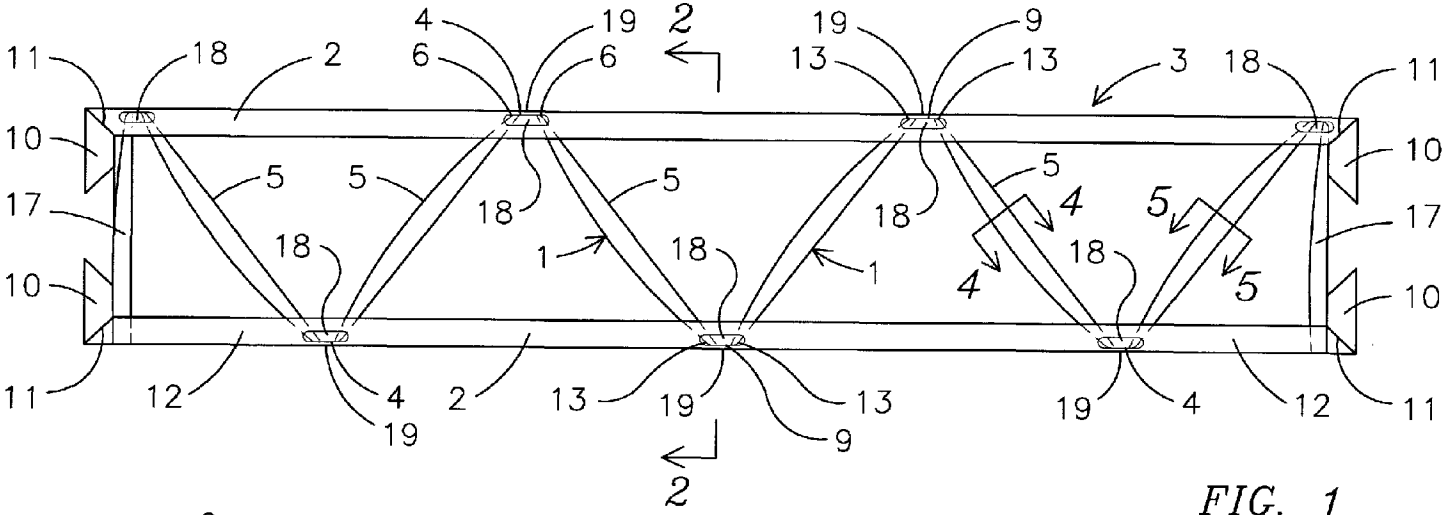
FIG. 1 is a side elevational plan view of the present invention.

Listed numerically below with reference to the drawings are terms used to describe features of this invention. These terms and numbers assigned to them designate the same features throughout this description.

1. strut member
2. u-shaped channel/chord
3. truss member
4. end portion
5. intermediate portion
6. apex
7. open end
8. closed end
10. end of chord
11. notch
12. cantilevered end

Figure 2:
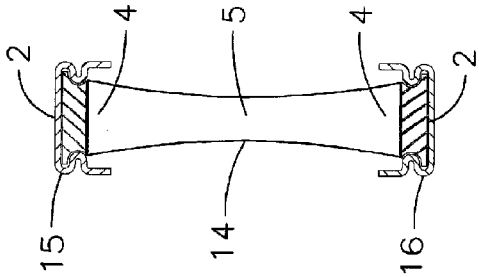
FIG. 2 is a cross sectional view along the line 2-2 of the embodiment of FIG. 1.
Figure 9:
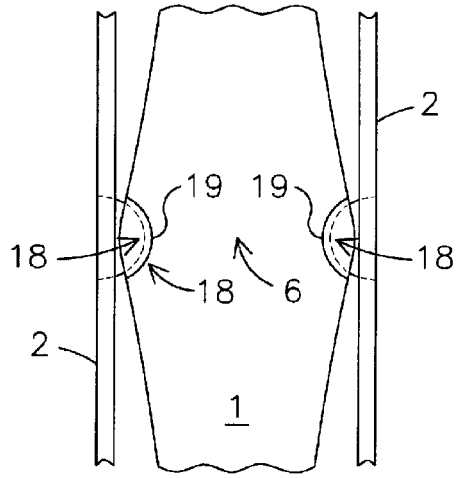
FIG. 9 is an upward looking plan view of a dimple of the present invention.
Figure 10:
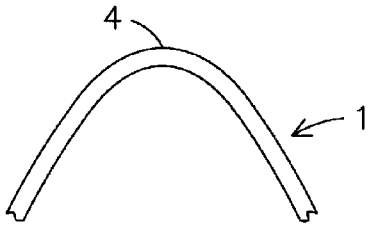
FIG. 10 is a side view of a substantially rounded end portion of a strut.

13. hollow rivet
14. middle
15. first end
16. second end
17. end strut member
18. crimp/clamp
19. dimple With reference to FIGS. 1 and 2, an improved structural truss of the present invention is shown. The improved truss has a plurality of strut members 1 having a first end 15, a middle 14 and a second end 16. The struts 1 have end portions 4 on the first end 15 and the second end 16 and are connected by non-flat intermediate portions 5 which are U-shaped or inverse U-shaped. The strut member 1 is bent at the end portions 4 to form alternately extending apices 6. The end portions 4 may be substantially flat shaped sections, substantially rounded sections (as shown in FIG. 9), bent sections (as shown in FIG. 10), etc. to facilitate the joining of the strut and the chords. The apices 6 of the strut members 1 are connected to the U-shaped channels 2 to form the truss member 3 at its cantilevered end. The U-shaped chord channels 2 have notches 11 punched out in equal distances from one another. The notches 11 are adjacent to the end pieces 6 of the truss member 3 and provide for bending the ends 10 of the chord channels 2 inward around an end strut member 17 to define and provide strength to each truss member 3. Each truss member 3 has cantilevered ends 12 to form each truss member 3. Apices 6 of the strut 1 are crimped and clamped onto the chord 2 so as to provide additional structural reinforcement for the improved structural truss. The last strut members 17 on each end in a truss member 3 is bent perpendicularly to the chord 2 and the ends of each chord 10 are bent at a notch 11 to provide closed ends to the truss members 3.

Figure 3:
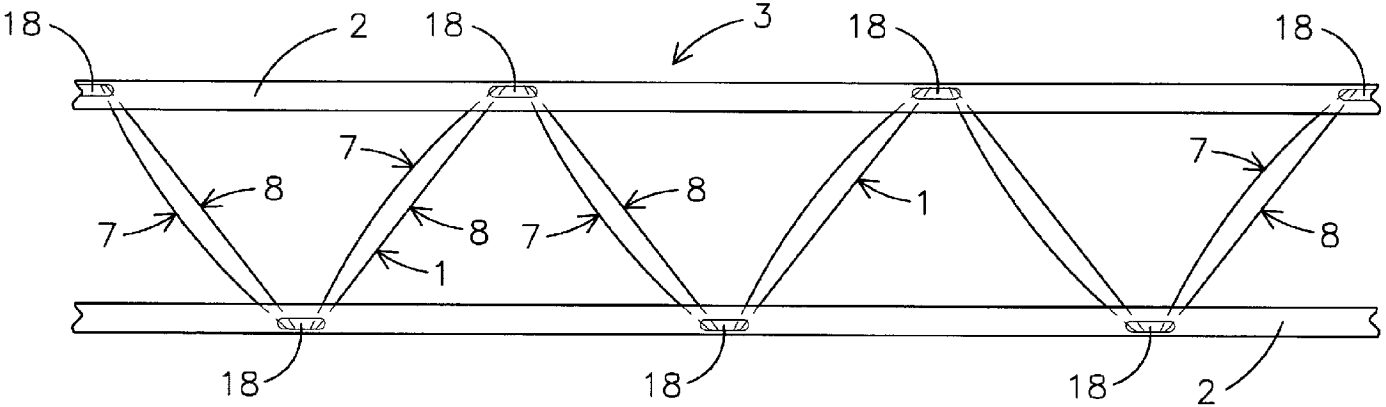
FIG. 3 is a side view of the improved truss of the present invention as a strut is inserted between the chords.

In FIG. 3, truss member 3 is shown with the strut member 1 inserted between the chords 2. The U-shaped portions of the struts 1 alternate in different directions, an open end 7 and a closed end 8, so that those portions of the strut members 1 contacting the chord 2 will be identical in shape.

Figure 5:
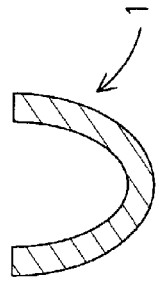
FIG. 5 is a cross sectional view along the line 5-5 of the embodiment of FIG. 1.
Figure 4:
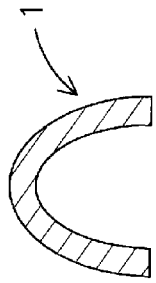
FIG. 4 is a cross sectional view along the line 4-4 of the embodiment of FIG. 1.

With reference to FIGS. 4 and 5, cross sectional views of alternating strut members 1 are shown to have inverse U-shaped and U-shaped features, respectively. This feature achieves a higher quality of strut member 1 to chord 10 connection by creating identically shaped apices 6.

Figure 6:
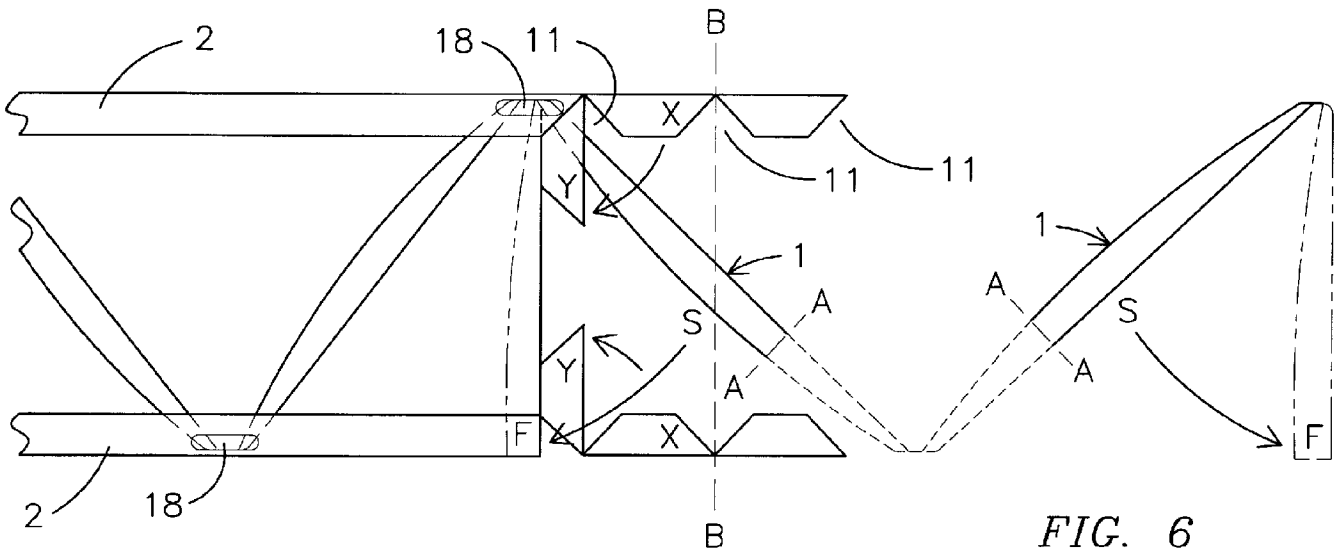
FIG. 6 is a cutaway side view of the present invention illustrating the operations performed on a cut strut and cut channel of the present invention.

With reference to FIG. 6, the method employed in fabricating the truss members of the present invention is described. First, a cut is made on the strut member 1 along lines A-A. The cut struts 17 are then folded from positions S to positions F. Then, another cut is made along line B-B through the U-shaped chord 2. Because the strut 1 was already folded, the cut along B-B will not cut the strut members 1. The U-shaped channel chords are then bent from positions X to positions Y to form the chord ends 10 of the truss member 1, as shown in FIG. 1.

Figure 7:
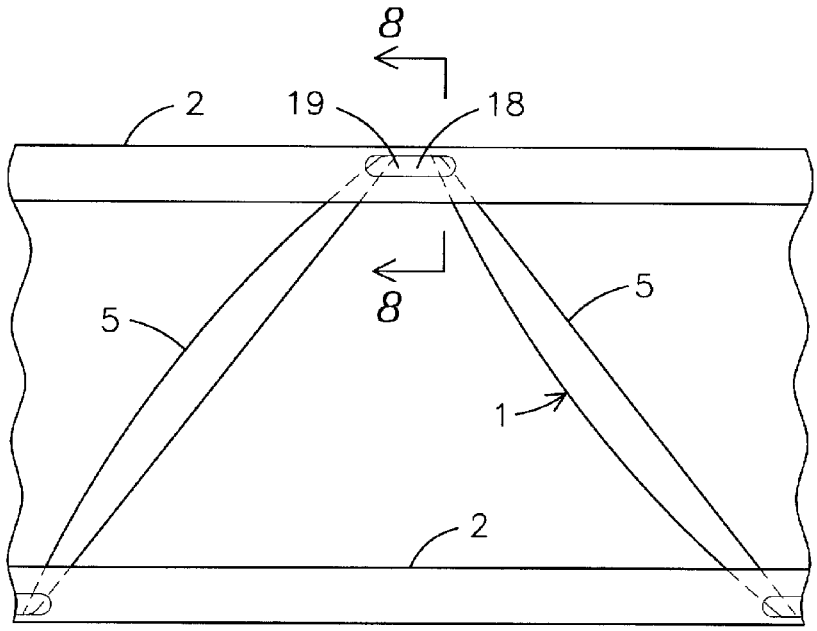
FIG. 7 is a side plan view of a dimple of the present invention.

In FIG. 7, a side plan view of the attachment of strut 1 to chord 2 is shown. As noted above, the attachment method shown has dimples 19 created by crimping/clamping 18 sides of chord 2 inward into the strut 1 and the apex 6, thus securing the strut 1 to the chord 2.

Figure 8:
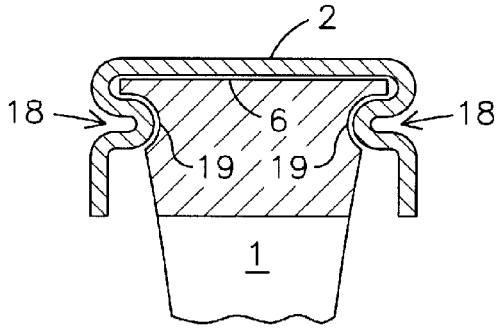
FIG. 8 is a cross sectional view along the line 8-8 of the embodiment of FIG. 7.

FIG. 8 shows a cross-sectional view along line 8-8 of the embodiment of FIG. 7 wherein the attachment is achieved by crimping the chord 2 to create a dimples 19 into the apex 6 from the chord 2.

FIG. 9 shows an upward looking plan view of the dimples 19 securing the apex 6 to the chord 2.

With reference to FIG. 10, a side view of a substantially rounded end portion 4 of a strut 1 is shown.

Figure 11:
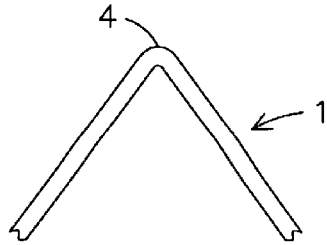
FIG. 11 is a side view of a substantially bent end portion of a strut side view of a second step of the riveting process of the present invention.

With reference to FIG. 11, a side view of a substantially bent end portion 4 of a strut 1 is shown.

The use of the present invention will improve the quality of the strut member to chord element connection.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A structural truss comprising:
at least two strut members having at least two alternately extending struts;
said at least two alternately extending struts having a first end, a middle and a second end;
said first end is connected to said second end by at least one first non-flat intermediate portion and at least one second non-flat intermediate portion;
said at least one first non-flat intermediate portion is U-shaped;
said at least one second non-flat intermediate portion is inverse U-shaped;
said first end and said second end are fastened to at least two chords;
at least two chords that are substantially U-shaped;
said at least two chords are secured to said at least two strut members via at least one dimple extending into the at least two chords and the at least two strut members, thereby creating at least one substantially S-shaped indentation in said at least two chords; and
said at least two chords are parallel in relation to one another.

2. The structural truss of claim 1 wherein:
said at least two extending struts are bent at said first end and at said second end to form a pair of alternately extending apices.

3. The structural truss of claim 1 wherein:
said at least two chords have at least one notch per chord.

4. The structural truss of claim 3 wherein:
said at least one notch per chord is adjacent to said apices.

5. The structural truss of claim 1 wherein:
said at least two extending struts are rounded at said first end and at said second end at least two flat portions to form a pair of alternately extending apices.

6. A structural truss comprising:
at least two strut members having at least two alternately extending struts;
said at least two alternately extending struts having a first end, a middle and a second end;
said first end is connected to said second end by at least one first non-flat intermediate portion and at least one second non-flat intermediate portion;
said at least one first non-flat intermediate portion is U-shaped;
said at least one second non-flat intermediate portion is inverse U-shaped;
said first end and said second end are fastened to at least two chords;
at least two chords that are substantially U-shaped;
said at least two chords are secured to said at least two strut members via at least one dimple extending into the at least two chords and the at least two strut members, thereby creating at least one substantially S-shaped indentation;

said at least two chords are parallel in relation to one another;

said at least two extending struts are bent at said first end and at said second end to form a pair of alternately extending apices.

7. The structural truss of claim 6 wherein:

said at least two chords have at least one notch per chord.

8. The structural truss of claim 7 wherein:

said at least one notch per chord is adjacent to said apices.

9. A structural truss comprising:

at least two strut members having at least two alternately extending struts;

said at least two alternately extending struts having a first end, a middle and a second end;

said first end is connected to said second end by at least one first non-flat intermediate portion and at least one second non-flat intermediate portion;

said at least one first non-flat intermediate portion is U-shaped;

said at least one second non-flat intermediate portion is inverse U-shaped;

said first end and said second end are fastened to at least two chords;

at least two chords that are substantially U-shaped;

said at least two chords are secured to said at least two strut members via at least one dimple extending into the at least two chords and the at least two strut members, thereby creating at least one substantially S-shaped indentation;

said at least two chords are parallel in relation to one another;

said at least two extending struts are rounded at said first end and at said second end to form a pair of alternately extending apices.

10. The structural truss of claim 9 wherein:

said at least two chords have at least one notch per chord.

11. The structural truss of claim 9 wherein:

said at least one notch per chord is adjacent to said apices.

* * * * *